United States Patent [19]

Brooks

[11] 4,180,268

[45] Dec. 25, 1979

[54] MAZE GAME

[76] Inventor: Nathaniel E. Brooks, 8901 Seneca La., Bethesda, Md. 20034

[21] Appl. No.: 888,747

[22] Filed: Mar. 21, 1978

[51] Int. Cl.[2] ..... A63F 9/06

[52] U.S. Cl. ..... 273/153 R; 273/1 R

[58] Field of Search ..... 273/153 R, 1 R, 241; 35/22 R; 33/233, 245

[56] References Cited

U.S. PATENT DOCUMENTS

| | | | |
|---|---|---|---|
| 3,399,895 | 9/1968 | Beach | 273/241 |
| 3,464,701 | 9/1969 | Mahoney | 273/241 |

FOREIGN PATENT DOCUMENTS

| | | | |
|---|---|---|---|
| 6137 | of 1908 | United Kingdom | 273/153 R |
| 426585 | 4/1935 | United Kingdom | 273/153 R |

*Primary Examiner*—Anton O. Oechsle

*Attorney, Agent, or Firm*—Craig and Antonelli

[57] ABSTRACT

A three-dimensional maze game wherein at least three substantially planar elements are maintained in substantially parallel spaced relation. One of the elements is provided with a sighting point thereon and the others of the elements are provided with indicia delimiting at least portions of a maze pattern and cooperating to delimit a total maze pattern. The elements are arranged for being viewed by a player so as to represent a sighting point disposed within an apparent total maze pattern.

5 Claims, 2 Drawing Figures

MAZE GAME

The present invention relates to an amusement device of the maze game type and, in particular, to a three-dimensional maze game.

Maze games are known wherein the object is to traverse an unobstructed path from a starting point to a finish point through a maze pattern of open and closed passageways. However, with the usual maze game, the entire maze can be seen and evaluated at the outset. Thus, the challenge of the game is reduced since the arrangement of the maze is static.

It is therefore an object of the present invention to provide a novel maze game wherein the maze paths appear to change thereby providing an ever increasing challenge to the player.

In accordance with the present invention, a variation in line-of-sight of the eye of a player is utilized to vary the apparent configuration of the maze. The game includes at least three spaced elements at least two of which are transparent and which bear indicia thereon cooperating to delimit a maze pattern. The other element is provided with indicia serving as a sighting point and representing an object to be guided through the cooperating maze pathways by visual sighting.

Figure 1:
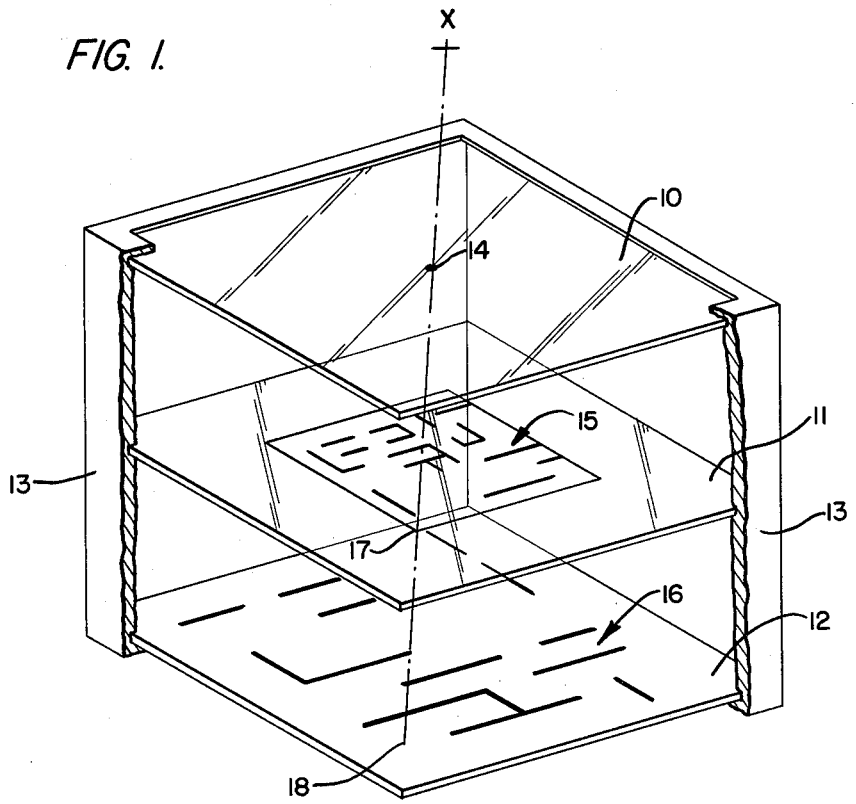
Figure 2:
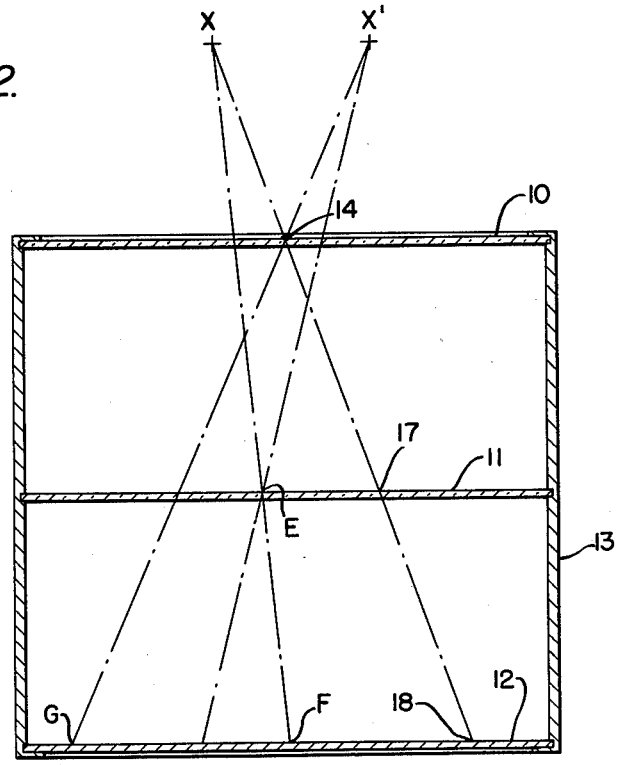

Other objects and advantages of this invention will become more apparent from the following description taken together with the accompanying drawings wherein:

FIG. 1 is a perspective view of the maze game of the present invention with the rectangular enclosure for maintaining the spatial relation of the elements being illustrated in a cut away view; and FIG. 2 is a cross sectional view of the maze game of the present invention.

Referring now to the drawings wherein like reference numerals are utilized to designate like parts throughout the several views, there is shown in FIG. 1 a perspective view of the maze game of the present invention including at least three substantially planar elements 10, 11 and 12 maintained in substantially parallel relationship by a four sided enclosure 13, shown in cut away view. The member 10, which delimits the upper level of the game, is provided with an indicia in the form of a dot 14. This dot 14 serves as a sighting point for the maze game. The middle or intermediate member 11, which serves as the intermediate level of the game, is provided with indicia 15 thereon delimiting at least a portion of a maze. The lower member 12 is also provided with indicia 16 thereon, which again delimits at least a portion of a maze whereby the indicia 15 and 16, when viewed through the transparent members 10 and 11, depict a maze. While the member 12 is preferably opaque, it is also possible to have such member be transparent. Additionally, the enclosure 13, which delimits at least the sides of the game, is preferably of an opaque material. The enclosure is preferably of such size that it is easily handled by a player. A player, by sighting from the point X representing the eye of the player, through the point 14 and along points 17 and 18, as shown by dash-dot line, defines a point in the apparent total maze and places point 14 visually at the locations 17 and 18 in each of the levels forming the total maze. By movement of the eye or movement of the game, such as tilting movement or the like, the player visually attempts to move the point 14 through the maze defined by the indicia on the planar members 11 and 12.

Referring to FIG. 2 of the drawings which represents a cross sectional view through the maze game of the present invention and utilizing X as the initial line-of-sight of the eye of the player, there is a line-of-sight for the point 14 placing the point 14 at locations 17 and 18 on members 11 and 12 as shown. From the point X, the eye also views portions of the maze as represented by points E and F, for example, in a particular spatial relationship so as to define a particular relationship for the apparent total maze since points E and F are superimposed. However, as the location of the eye is changed to point X′ or the game is rotated or tilted, so as to visually move the point 14 through the maze, the point 14 appears to be at point G in the maze. From this viewpoint, the points E and F no longer appear superimposed so that there is a change in apparent relationship of the indicia on the member 11 with respect to the indicia forming the maze on member 12. Accordingly, either as the eye moves or movement of the maze presents a change in eye movement, the pattern of the maze, as provided on members 11 and 12, appears to change opening and closing different pathways through the maze so as to change the pathways in which the point 14 can visually be moved therethrough.

The present invention thus utilizes the changing line-of-sight of the eye of a player to vary the apparent configuration of the maze as delimited on the at least two spaced members 11 and 12. While the player, upon initially sighting into the game, sees an apparent complete maze and the sighting point appearing together in a predetermined spatial relationship, as the device is tilted or the player's eye is moved causing the line-of-sight of the eye to change, the sighting point appears to the player to move through the maze. Concurrently, the tilting of the maze or the like causes a change in the relationship of the eye and the two or more levels on which portions of the maze are inscribed. The eye thus visualizes apparent changes in the maze in which obstacles appear, move or disappear presenting variations in the maze and thereby presenting unexpected challenges to the player.

As is readily apparent, numerous variations of the maze game can be utilized in accordance with the device of the present invention. For example, the entire device may be encapsulated in a clear or tinted plastic material and the sighting point may be arranged above, below or intermediate to the levels containing various portions of the maze. Additionally, the levels in which the maze portions are inscribed may be constructed to be removable so various types of designs of mazes can be incorporated in a single device. Thus, while a preferred embodiment of the device of the present invention has been described and illustrated, variations and modifications of the device are deemed to fall within the spirit and scope of the present invention as defined by the appended claims.

I claim:

1. A three-dimensional amusement device comprising at least three substantially planar elements, means for maintaining said substantially panar elements in substantially parallel spaced relationship, said at least three elements including first and second spaced elements and at least one intermediate element spaced from said first and second elements and disposed therebetween, one of said first, second and intermediate elements being provided thereon with indicia in the form of a sighting point representing an object to be visually moved through a maze pattern of open and closed passageways and the others of said first, second and intermediate elements being each provided thereon with indicia forming at least a portion of the maze pattern and cooperating to delimit a total maze pattern, said first, second and intermediate elements being arranged for being viewed by a player so as to represent a sighting point disposed within an apparent total maze pattern formed by the other elements.

2. A three-dimensional amusement game device according to claim 1, wherein said at least one intermediate element is transparent and at least one of said first and second elements is transparent.

3. A three-dimensional amusement game device according to claim 2, wherein said first element is provided with the sighting point thereon, and said at least one intermediate element and said second element are respectively provided with at least portions of the maze pattern thereon, said second element being opaque.

4. A three-dimensional amusement game device according to claim 2, wherein said first, second and intermediate elements are arranged so as to initially represent a sighting point disposed within an apparent total maze pattern when viewed by a player along a first line-of-sight and to represent a changing maze pattern upon changing of the line-of-sight of the player.

5. A three-dimensional amusement game device according to claim 2, wherein the means for maintaining the elements in spaced relation is a rectangular structural member.

* * * * *